US005507105A

United States Patent [19]

Cancel

[11] Patent Number: 5,507,105

[45] Date of Patent: Apr. 16, 1996

[54] SHOE HEEL PROTECTOR

[76] Inventor: Miguel A. Cancel, 1435 Harrod Ave., Apt. 8K, Bronx, N.Y. 10472

[21] Appl. No.: 408,531

[22] Filed: Mar. 22, 1995

[51] Int. Cl.[6] ..... A43B 13/22

[52] U.S. Cl. ..... 36/72 B; 36/72 R

[58] Field of Search ..... 36/72 B, 73, 1.5, 36/2 R, 118, 69, 89, 90, 71, 105, 109, 136

[56] References Cited

U.S. PATENT DOCUMENTS

| | | | |
|---|---|---|---|
| 2,432,648 | 12/1947 | Beckwith | 36/2 R |
| 2,563,763 | 8/1951 | Vietas | 36/2 R |
| 3,104,479 | 9/1963 | D'Amico | 36/72 B |
| 4,662,082 | 5/1987 | Shabazz | 36/72 B |

FOREIGN PATENT DOCUMENTS

| | | | |
|---|---|---|---|
| 2250268 | 7/1975 | France | 36/72 B |
| 2338664 | 9/1977 | France | 36/72 B |
| 2190823 | 12/1987 | United Kingdom | 36/72 B |

*Primary Examiner*—Paul T. Sewell
*Assistant Examiner*—Ted Kavanaugh

[57] ABSTRACT

A protector for covering a heel of a shoe. The inventive device includes a covering assembly positionable over and partially under a heel of a shoe. A mounting assembly extends from the covering assembly for positioning about the shoe to secure the device relative thereto. An adjustable panel can be extended from the covering assembly to adjust a height of the device to fit a particular shoe.

4 Claims, 3 Drawing Sheets

SHOE HEEL PROTECTOR

BACKGROUND OF THE INVENTION

1. Field of the Invention

The present invention relates to covering devices and more particularly pertains to an shoe heel protector for covering a heel of a shoe to protect the same from damage.

2. Description of the Prior Art

The use of covering devices is known in the prior art. More specifically, covering devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art covering devices include U.S. Pat. Nos. 4,005,534; 4,441,264; 4,461,100; 4,727,659; 4,779,295; 4,872,271; and U.S. Pat. No. Des. 337,421.

While these devices fulfill their respective, particular objectives and requirements, the aforementioned patents do not disclose a shoe heel protector for covering a heel of a shoe which includes a covering assembly positionable over and partially under a heel of a shoe, a mounting assembly extending from the covering assembly for positioning about the shoe to secure the device relative thereto, and an adjustable panel extendable from the covering assembly so as to adjust a height of the device to fit a particular shoe size.

In these respects, the shoe heel protector according to the present invention substantially departs from the conventional concepts and designs of the prior art, and in so doing provides an apparatus primarily developed for the purpose of covering a heel of a shoe to protect the same from damage or scuffing.

SUMMARY OF THE INVENTION

In view of the foregoing disadvantages inherent in the known types of covering devices now present in the prior art, the present invention provides a new shoe heel protector construction wherein the same can be utilized for protectively covering a heel of a shoe. As such, the general purpose of the present invention, which will be described subsequently in greater detail, is to provide a new shoe heel protector apparatus and method which has many of the advantages of the covering devices mentioned heretofore and many novel features that result in a shoe heel protector which is not anticipated, rendered obvious, suggested, or even implied by any of the prior art covering devices, either alone or in any combination thereof.

To attain this, the present invention generally comprises a protector for covering a heel of a shoe. The inventive device includes a covering assembly positionable over and partially under a heel of a shoe. A mounting assembly extends from the covering assembly for positioning about the shoe to secure the device relative thereto. An adjustable panel can be extended from the covering assembly to adjust a height of the device to fit a particular shoe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoe heel protector apparatus and method which has many of the advantages of the covering devices mentioned heretofore and many novel features that result in a shoe heel protector which is not anticipated, rendered obvious, suggested, or even implied by any of the prior art covering devices, either alone or in any combination thereof.

It is another object of the present invention to provide a new shoe heel protector which may be easily and efficiently manufactured and marketed.

It is a further object of the present invention to provide a new shoe heel protector which is of a durable and reliable construction.

An even further object of the present invention is to provide a new shoe heel protector which is susceptible of a low cost of manufacture with regard to both materials and labor, and which accordingly is then susceptible of low prices of sale to the consuming public, thereby making such shoe heel protectors economically available to the buying public.

Still yet another object of the present invention is to provide a new shoe heel protector which provides in the apparatuses and methods of the prior art some of the advantages thereof, while simultaneously overcoming some of the disadvantages normally associated therewith.

Still another object of the present invention is to provide a new shoe heel protector for protectively covering a heel of a shoe to prevent damage or scuffing of the heel.

Yet another object of the present invention is to provide a new shoe heel protector which includes a covering assembly positionable over and partially under a heel of a shoe, a mounting assembly extending from the covering assembly for positioning about the shoe to secure the device relative thereto, and an adjustable panel extendable from the covering assembly so as to adjust a height of the device to fit a particular shoe size.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
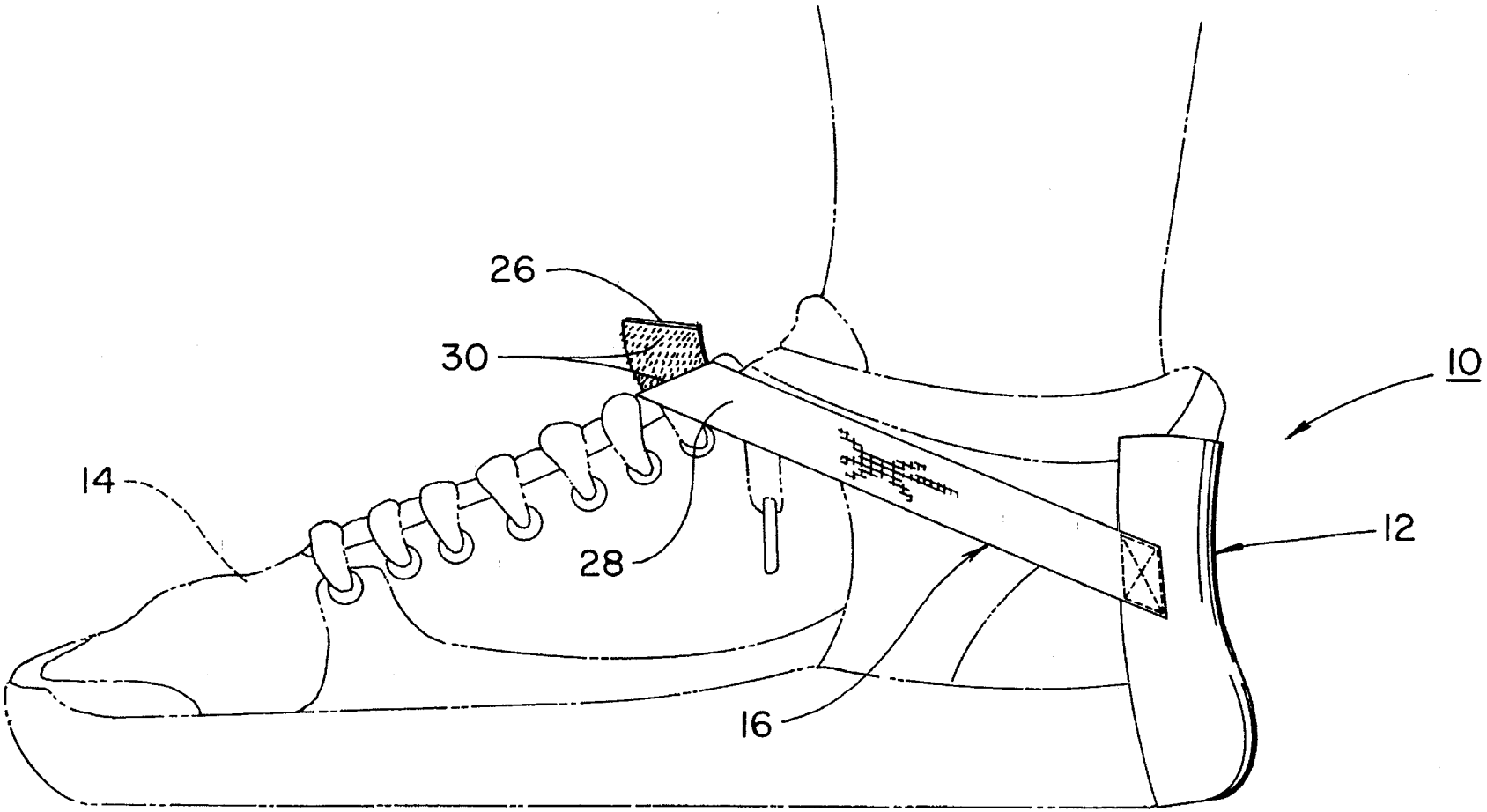
FIG. 1 is a side elevation view of a shoe heel protector according to the present invention in use.

With reference now to the drawings, and in particular to FIGS. 1–5 thereof, a new shoe heel protector embodying the principles and concepts of the present invention and generally designated by the reference numeral 10 will be described.

More specifically, it will be noted that the shoe heel protector to comprises a covering means 12 for positioning about a rear heel portion of a shoe 14 and for protecting the rear heel portion of the shoe from damage thereto such as occurs during driving of a vehicle or the like. A mounting means 16 is coupled to the covering means 12 for positioning about the shoe 14 and/or an ankle of an individual wearing the shoe so as to secure the covering means 12 relative to the shoe 14. By this structure, the rear heel portion of the shoe is protected from scuffing or abrasion against a floor surface of an automobile during driving thereof.

Figure 2:
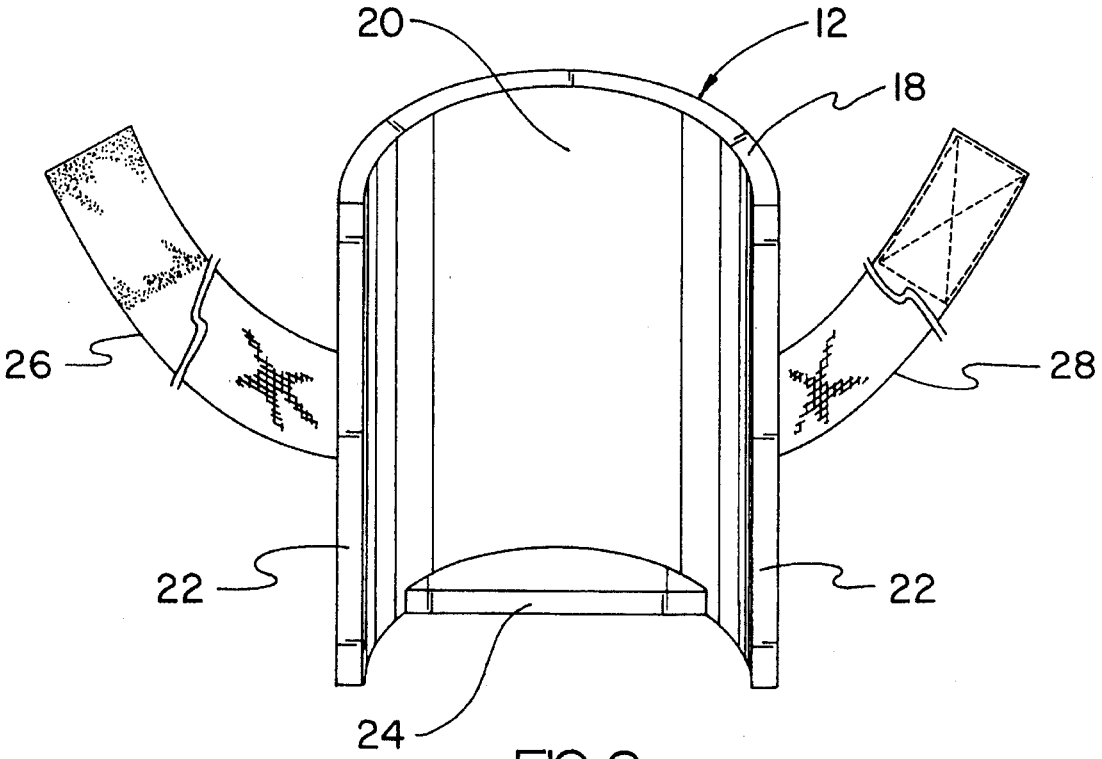
FIG. 2 is an isometric illustration of the invention, per se.
Figure 3:
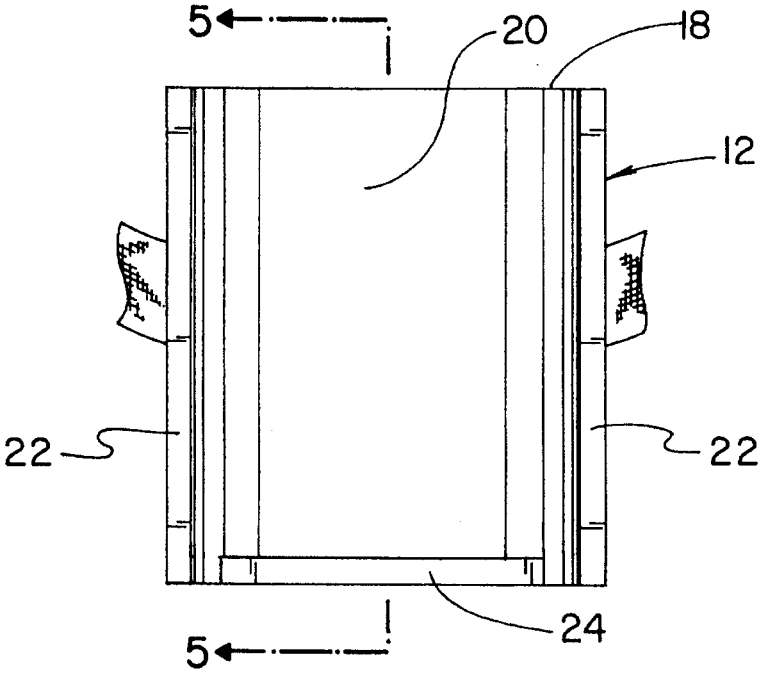
FIG. 3 is a front elevation view thereof.

As best illustrated in FIGS. 1 through 3, it can be shown that the covering means 12 according to the present invention 10 preferably comprises a substantially U-shaped member 18 positionable about the rear heel portion of the shoe 14. More specifically, the U-shaped member 18 includes a central arcuate panel 20 positionable about the rear heel portion of the shoe 14, with lateral panels 22 projecting from opposed vertical edges of the central arcuate panel 20 into a substantially spaced and parallel orientation for positioning along laterally opposed portions of the shoe 14. A planar foot member 24 extends across a lower horizontal edge of the central arcuate panel 20 and can be positioned beneath the heel of the shoe 14 so as to preclude a vertical rising of the covering means 12 relative to the shoe when the device 10 is in use.

As best illustrated in FIGS. 1 and 2, it can be shown that the mounting means 16 according to the present invention 10 preferably comprise a first strap 26 secured to a first one of the lateral panels 22 of the covering means 12, and a second strap 28 secured to a second one of the lateral panels 22 of the covering means 12. The straps 26 and 28 extend from the covering means 12 to terminate in free distal ends whereat hook and loop material 30 is secured. The hook and loop material 30 of the straps 26 and 28 permits joining of the free distal ends of the straps about the shoe 14 and/or an ankle of an individual wearing the shoe. By this structure, the present invention 10 can be easily coupled and/or decoupled from an associated shoe 14 as desired by an end user.

Figure 4:
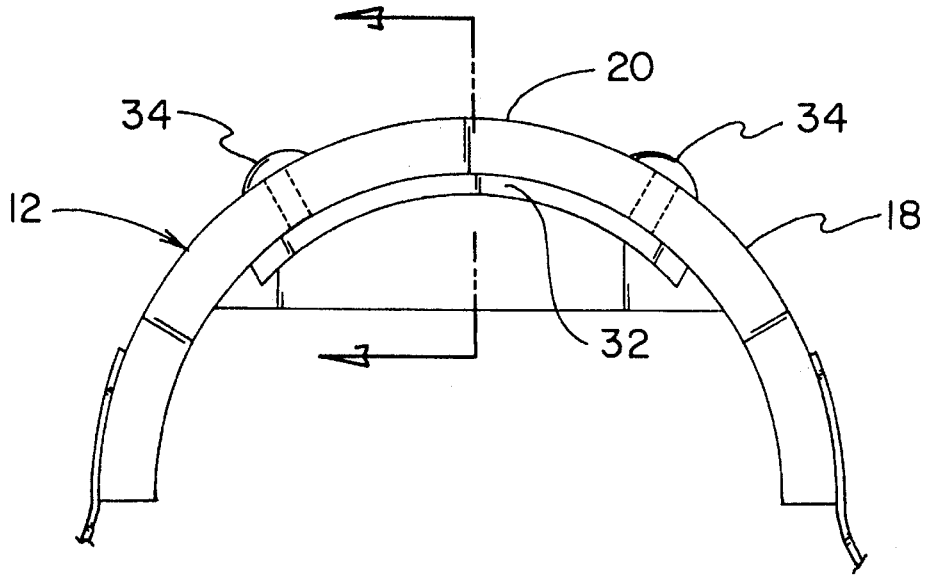
FIG. 4 is a top plan view of the present invention.
Figure 5:
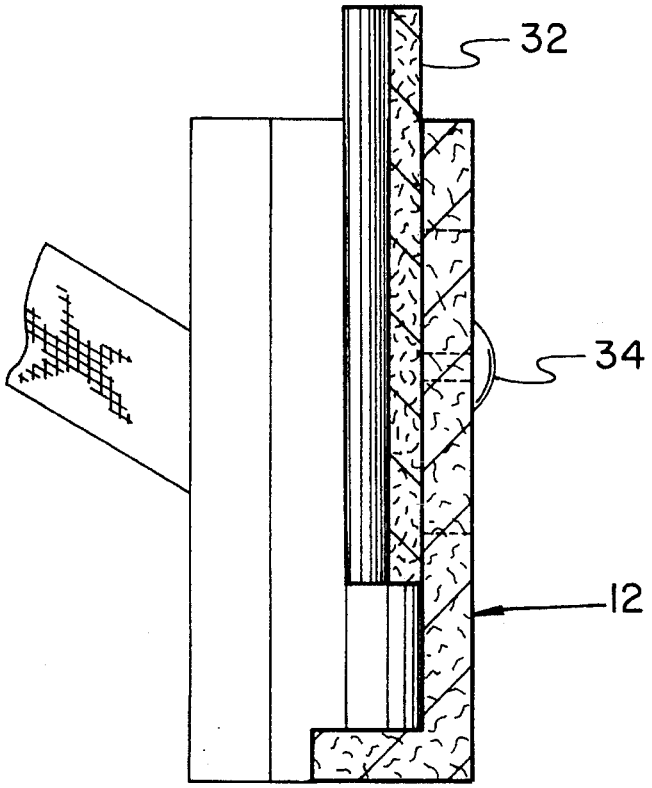
FIG. 5 is a cross sectional view taken along line 5—5 of FIG. 3.

Referring now to FIGS. 4 and 5, it can be shown that the covering means 12 of the present invention 10 may further comprise an adjustable panel 32 movably mounted relative to the central arcuate panel 20 of the covering means 12. To this end, the central arcuate panel 20 preferably includes at least one vertically oriented slot directed therethrough, with at least one mounting pin 34 extending through the slot in the central arcuate panel 20 and coupled to the adjustable panel 32 so as to movably mount the same relative to an interior or exterior surface of the central arcuate panel 20. Preferably, the central arcuate panel 20 is shaped so as to define a pair of spaced vertical slots directed therethrough, wherein a pair of mounting pins 34 is utilized such that the adjustable panel 34 is supported against rotating motion relative to the covering means 12. By this structure, the adjustable panel 32 can be extended from the covering means 12 so as to cover an entire rear heel portion of the associated shoe 14 as desired by a user.

In use, the shoe heel protector 10 according to the present invention can easily utilized for covering a heel of a shoe so as to protect the same from damage or scuffing such as commonly occurs during driving of a vehicle or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoe heel protector comprising:

a covering means for positioning about a rear heel portion of a shoe and for protecting the rear heel portion of the shoe from damage thereto, the covering means comprising a substantially U-shaped member positionable about the rear heel portion of the shoe, the U-shaped member including a central arcuate panel adapted to be positionable about the rear heel portion of the shoe, with the central arcuate panel being shaped so as to define at least one vertically oriented slot directed therethrough;

an adjustable panel movably mounted relative to the central arcuate panel of the covering means;

at least one mounting pin extending through the slot in the central arcuate panel and being coupled to the adjustable panel so as to movably mount the adjustable panel relative to the central arcuate panel; and, a mounting means coupled to the covering means for positioning about the shoe to secure the covering means relative to the shoe.

2. A shoe heel protector comprising:

a covering means for positioning about a rear heel portion of a shoe and for protecting the rear heel portion of the shoe from damage thereto;

a mounting means coupled to the covering means for positioning about the shoe to secure the covering means relative to the shoe;

wherein the covering means comprises a substantially U-shaped member positionable about the rear heel portion of the shoe, the U-shaped member including a central arcuate panel adapted to be positionable about the rear heel portion of the shoe, lateral panels projecting from opposed vertical edges of the central arcuate panel and into a substantially spaced and parallel orientation, and a planar foot member extending across a lower horizontal edge of the central arcuate panel and adapted for positioning beneath the heel of the shoe so as to preclude a vertical rising of the covering means relative to the shoe when attached thereto;

wherein the mounting means comprises a first strap secured to a first one of the lateral panels of the covering means, and a second strap secured to a second one of the lateral panels of the covering means, the straps extending from the covering means and terminating in free distal ends whereat cooperative hook and loop material is secured;

wherein the covering means further comprises an adjustable panel movably mounted relative to the central arcuate panel of the covering means;

wherein the central arcuate panel is shaped so as to define at least one vertically oriented slot directed therethrough; and further comprising at least one mounting pin extending through the slot in the central arcuate panel and being coupled to the adjustable panel so as to movably mount the adjustable panel relative to the central arcuate panel.

3. The shoe heel protector of claim 2, wherein the central arcuate panel is shaped so as to define a pair of spaced and parallel vertically oriented slots directed therethrough; and further comprising a pair of mounting pins extending through the slot in the central arcuate panel and being coupled to the adjustable panel so as to movably mount the adjustable panel relative to the central arcuate panel.

4. The shoe heel protector of claim 3, wherein the adjustable panel is mounted adjacent to an interior of the central arcuate panel.

* * * * *